United States Patent [19]

Franke et al.

[11] Patent Number: 4,968,324

[45] Date of Patent: Nov. 6, 1990

[54] PROCESS FOR PRODUCING A SOLID, FINELY DIVIDED FUEL BASED ON COAL

[75] Inventors: Friedrich H. Franke, Schonstett; Michael J. Paersch, Hamburg, both of Fed. Rep. of Germany

[73] Assignee: Deutsche BP AG, Wedel/Holstein, Fed. Rep. of Germany

[21] Appl. No.: 364,738

[22] Filed: Jun. 9, 1989

[30] Foreign Application Priority Data

Jun. 13, 1988 [DE] Fed. Rep. of Germany ..... 3820077

[51] Int. Cl.[5] ..... C10L 10/00

[52] U.S. Cl. ..... 44/604; 44/641

[58] Field of Search ..... 44/604, 640, 641

[56] References Cited

U.S. PATENT DOCUMENTS

| | | | |
|---|---|---|---|
| 3,800,466 | 4/1974 | Heit | 44/640 |
| 4,307,207 | 11/1981 | Paspek | 44/604 |
| 4,526,703 | 7/1985 | Gebhard | 44/641 |
| 4,824,441 | 4/1989 | Kindig | 44/641 |

FOREIGN PATENT DOCUMENTS

| | | | |
|---|---|---|---|
| 3437074 | 4/1986 | Fed. Rep. of Germany | 44/604 |

*Primary Examiner*—Carl F. Dees

[57] ABSTRACT

Solid, finely divided fuels based on coal with a particle size distribution according to which at least 90% of the particles have a size of less than 90 μm, whereby the fuel contains 0.1 to 5 wt % calcium compounds and 0.01 to 1 wt % of a halogen-free and sulfur-free water-soluble iron compound, each based on dry weight, plus calcium and iron, permit an effective reduction n nitrogen oxide emissions in combustion gases when produced in such a way that the coal is impregnated with a 5 to 60 wt % aqueous solution of the iron salt and separately from that is also impregnated with a 10 to 75 wt % solution or suspension of calcium hydroxide and water in the absence of briquetting or pelletizing binders and then is milled in a milling and drying installation and dried to a water content of less than 1 wt %.

4 Claims, No Drawings

PROCESS FOR PRODUCING A SOLID, FINELY DIVIDED FUEL BASED ON COAL

BACKGROUND OF THE INVENTION

It is known that calcium and iron compounds can be added to coal based fuels to function as so-called sulfur scavengers. For example, U.S. Pat. No. C 4,302,207 describes fuels based on coal which contain calcium oxide, calcium carbonate, organic calcium salts, iron oxide, iron carboxylate, etc., in addition to organic or inorganic binders. The fuels produced in this way can be burned as such or converted to a lump form, e.g., by extrusion.

In production of finely divided fuels based on coal of the type described initially an especially fine distribution of the iron and calcium compounds in the fuel is especially important in order to effectively reduce the sulfur dioxide content of the offgases. With the processes known in the past such a fine distribution could not be achieved at all or could be achieved only inadequately due to the dry mixing of additives containing iron and calcium. The process according to this invention is based on the elimination of this disadvantage.

SUMMARY OF THE INVENTION

The problem described above is solved according to this invention by the fact that coal is impregnated with a 5 to 60 wt% aqueous solution of the iron salt and separately is also treated with a 10 to 75 wt% solution or suspension of calcium hydroxide in water in the absence of briquetting or pelletizing binders and then is ground in a milling and drying installation and dried to a water content of less than 1 wt%.

By separate addition of aqueous solutions or suspensions of iron salts and calcium hydroxide, premature precipitation of basic iron compounds is avoided. Precipitation does not take place in the process according to this invention until immediately before the milling and drying operation or in the course thereof.

According to this invention it is possible to start with coal particles that are larger than the fuel to be produced. However, it is also possible to use coal that already has the desired particle size distribution of the fuel Then it is merely the intense mixing effect of the milling operation that is utilized although the milling operation is no longer necessary for the purpose of reducing the particle size.

It has surprisingly been found that the fuels produced according to this invention permit an effective reduction in nitrogen oxide emissions.

Suitable coal materials for use in the process according to this invention include the conventional types of soft and hard coal, but especially hard coal or glance coal. The preferred iron salts are salts of iron with organic acids.

According to a preferred version of this invention, the coal is impregnated with 3.5 to 5 wt% aqueous iron salt solution and with 5 to 9 wt% calcium hydroxide solution or suspension.

Use of the calcium hydroxide solution or suspension partially neutralized with a volatile organic acid, especially formic acid and acetic acid, is especially preferred. Addition of up to 60 wt% organic acid to the calcium hydroxide solution or suspension is preferred.

Together with the solutions of the iron salts and solutions or suspensions of calcium hydroxide to be used in the process according to this invention, iron aggregates may also be used, e.g., iron oxide, iron carbonate and/or elemental iron, including essentially halogen-free iron-rich minerals or industrial wastes that contain or form such compounds, e.g., basic iron hydroxides, iron wastes from the metallurgical industry, e.g. oxygen dust [sic], blast furnace flue dust, blast furnace slurry, LD process slurry, rolling mill scale, rolling mill mud or red mud (the term iron rich is to be understood here as referring to an iron content of at least 20 wt%, especially 30 to 60 wt%). In addition, $CaCO_3$ aggregates such as dolomite, chalk, etc. may also be used. Such aggregates may be added in the form of dry finely divided material or in the for of aqueous suspension.

DETAILED DESCRIPTION OF THE INVENTION

This invention will be explained in greater detail below with reference to a preferred practical example.

EXAMPLE

A fat coal from the Ruhr district with a particle size distribution wherein 90 wt% of the particles are smaller than 90 μm was placed in a 40 wt% aqueous solution of iron citrate containing 0.9 wt% iron (based on coal) and a 50 wt% solution or suspension of fine white lime (about 96% calcium hydroxide) containing 2.9 wt% calcium (based on coal) in a 40 wt% aqueous acetic acid solution and mixed thoroughly. This fuel mixture was dried in a combined milling and drying installation to a water content of less than 1 wt%.

The resultant dray fuel was used in a laboratory dust incineration installation. On the basis of the measurement log representing a continuous record of measurement analyzers during the combustion, a reduction in nitrogen oxide emissions of 30% in comparison with untreated fine-grained coal was obtained as shown by the following summary:

| Additive | NOx (average calculated as $NO_2$ at 7 vol % $O_2$) | $NO_2$ reduction |
|---|---|---|
| — | 950 mg. $NO_2/m^3$ [STP] offgas | — |
| Example | 660 mg. $NO_2/m^3$ [STP] offgas | 30.5% |

We claim:

1. Process for producing a solid, finely divided fuel based on coal with a particle size distribution according to which at least 90% of the particles are less than 90 μm in size, and the fuel contains 0.1 to 5 wt% calcium compounds and 0.01 to 1 wt% of a halogen-free and sulfur-free water-soluble iron compound, each based on the dry weight, plus calcium and iron, characterized in that coal is impregnated with a 5 to 60 wt% solution of iron salt and separately is also impregnated with a 10 to 75 wt% solution or suspension of calcium hydroxide in water in the absence of briquetting or pelletizing binders and is then milled in a milling and drying installation where it is also dried to a water content of less than 1 wt%.

2. Process according to claim 1 characterized in that the coal is impregnated with 3.5 to 5 wt% aqueous iron salt solution.

3. Process according to claims 2 characterized in that the coal is impregnated with 5 to 9 wt% of the calcium hydroxide solution or suspension.

4. Process according to one of claims 1 to 3 characterized in that the calcium hydroxide solution or suspension that is used has up to 60 wt% of an organic acid added to it.

* * * * *